US005826796A

United States Patent [19]

McDonald

[11] Patent Number: 5,826,796

[45] Date of Patent: Oct. 27, 1998

[54] MULTI-DIRECTIONAL DEFENSIVE SPRAP CONTAINER

[76] Inventor: Kenneth J. McDonald, 4063 Vine La., Naples, Fla. 34112

[21] Appl. No.: 924,899

[22] Filed: Sep. 8, 1997

[51] Int. Cl.[6] ..... B05B 1/34

[52] U.S. Cl. ..... 239/327; 222/211; 222/212

[58] Field of Search ..... 239/327; 222/211–212, 222/215, 549, 131

[56] References Cited

U.S. PATENT DOCUMENTS

| | | | |
|---|---|---|---|
| 1,863,158 | 6/1932 | Greene | 239/327 |
| 2,700,578 | 1/1955 | Efford | 222/131 |
| 2,823,836 | 2/1958 | Bach | 222/212 |
| 2,980,342 | 4/1961 | Armour | 222/211 |

*Primary Examiner*—Gregory L. Huson
*Assistant Examiner*—David Deal

[57] ABSTRACT

The disclosure is directed to a multi-directional defensive spray container. It includes a regular plastic material bottle that can be squeezed such as a small shampoo bottle. Within the neck of the bottle there is located a rubber grommet having an evacuation tube attached thereto which extends into the bottle. At the opening of the neck of the bottle there is located a T-washer having an upper flat surface. A screw cap is screwed over the neck of the bottle and the top of the cap has a multiple of holes therein that will seal against the top of the T-washer when the cap is screwed down. An O-ring is placed over the neck of the bottle and will seal any liquid from escaping with the interior wall of the screw cap. Once a defensive liquid is placed within the bottle, a mere ¼ turn of the screw cap is enough to expel liquid through the multiple of holes when the bottle is squeezed. The bottle can be used in any position to expel the liquid.

5 Claims, 2 Drawing Sheets

MULTI-DIRECTIONAL DEFENSIVE SPRAP CONTAINER

BACKGROUND OF THE INVENTION

This invention relates to a container having a defensive liquid therein. By defensive liquid is meant a liquid that immediately will disable a predator or an attacker for a certain period of time which enables the targeted victim to escape. Such liquid is also used to immediately subdue a person who is out of control and cannot be subdued by any other measures. Of course, such containers having the defensive liquid therein are well known to be used mostly by law enforcement personal and is standard equipment on their person. This equipment is known under "maze" sprayers and it is known to be effective for its intended purpose and when used. The maze sprayers, of course, can be used by individuals also as a preventive measure against attacks should they occur. These maze sprayers are self-contained and have the defensive liquid contained therein under pressure by some other medium. Once the liquid has been expelled the container cannot be recharged. Another problem with such a maze sprayer is that it is not multi-directional, that is, that the liquid is expelled from the container at a right angle from the longitudinal axis of the container and then in one direction only. The container has a spray nozzle that is finger operated away from the user. This is especially cumbersome when the spray nozzle must be operated in the dark and it is extremely difficult to find the correct spray direction when only the tactile sense is available. If one is in a hurry, the spray can easily be directed toward the person using it which would have severe adverse effects. The maze containers are is also known to have a limited shelf life because any pressurized liquid will eventually loose its pressure medium.

OBJECT OF THE INVENTION

An object of the invention is to create a defensive spray container that obviates the above noted disadvantages or draw-backs of the well known maze sprayers. First of all the defensive liquid is not under any pressure when not in use and therefore has an extremely long shelf live. Secondly, the spray direction is multi-directional and therefore, the intended direction of the spray cannot be mistaken by the user. Thirdly, the container itself is inconspicuous, that is, it cannot be identified as a defensive spray container unlike the maze sprayer which immediately stands for what it is. The components of the multi-directional defensive spray container are very simple and are readily available on the open market in general or hardware stores. The individual parts or components are ready for use and do not have to be modified in any way except for the cap which needs a very simple modification which will be described hereinafter.

DETAILED DESCRIPTION OF THE DRAWINGS

Figure 1:
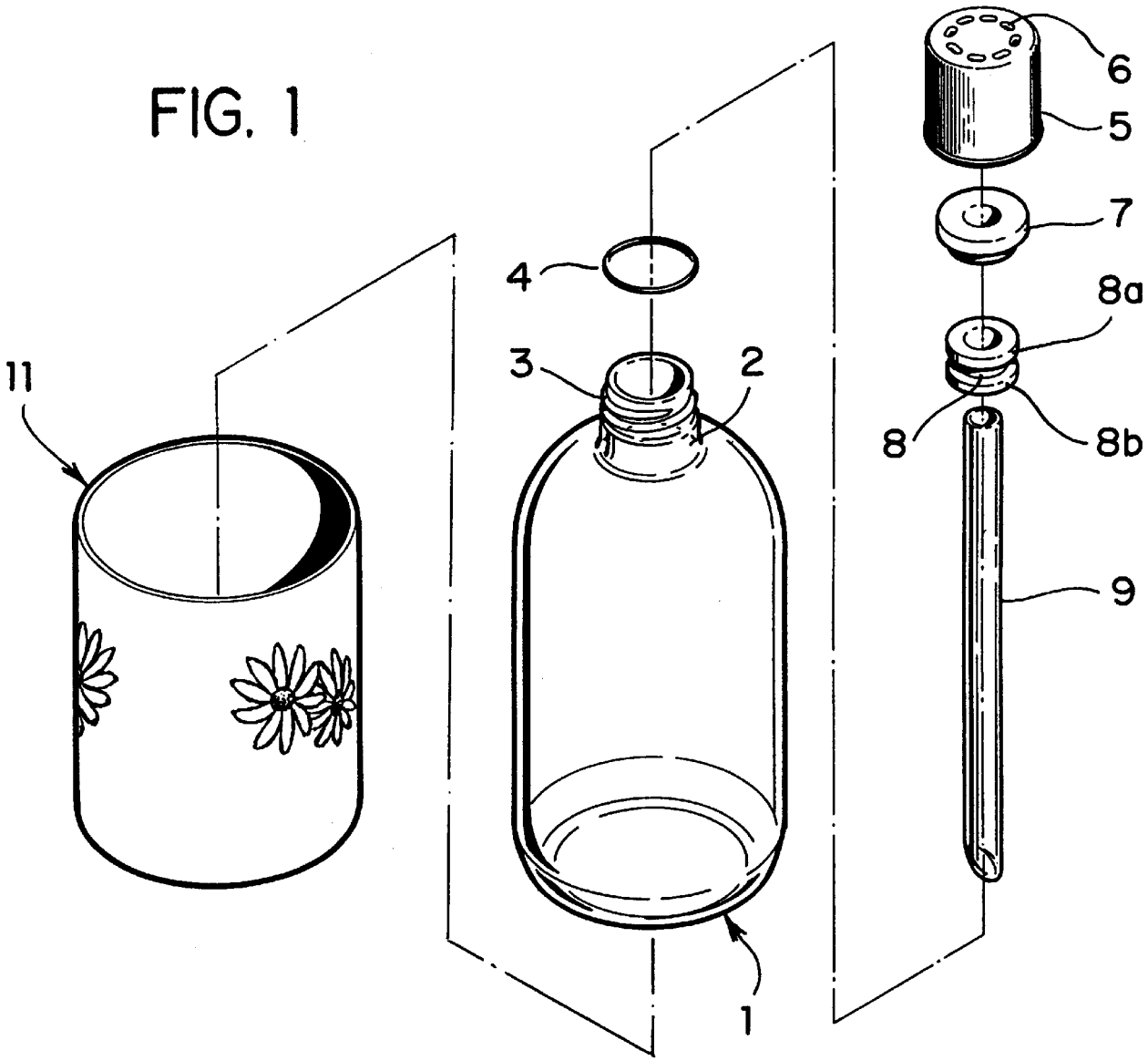
FIG. 1 is an exploded view of the various parts or components of the defensive spray container.

Referring now to FIG. 1, the numeral 1 indicates a standard bottle which can be found on the open market and is made of a low density polyethylene. It is therefore a somewhat soft plastic material that can squeezed time and time again without fatiguing or cracking. This characteristic will become apparent as the description continues below.

Figure 2:
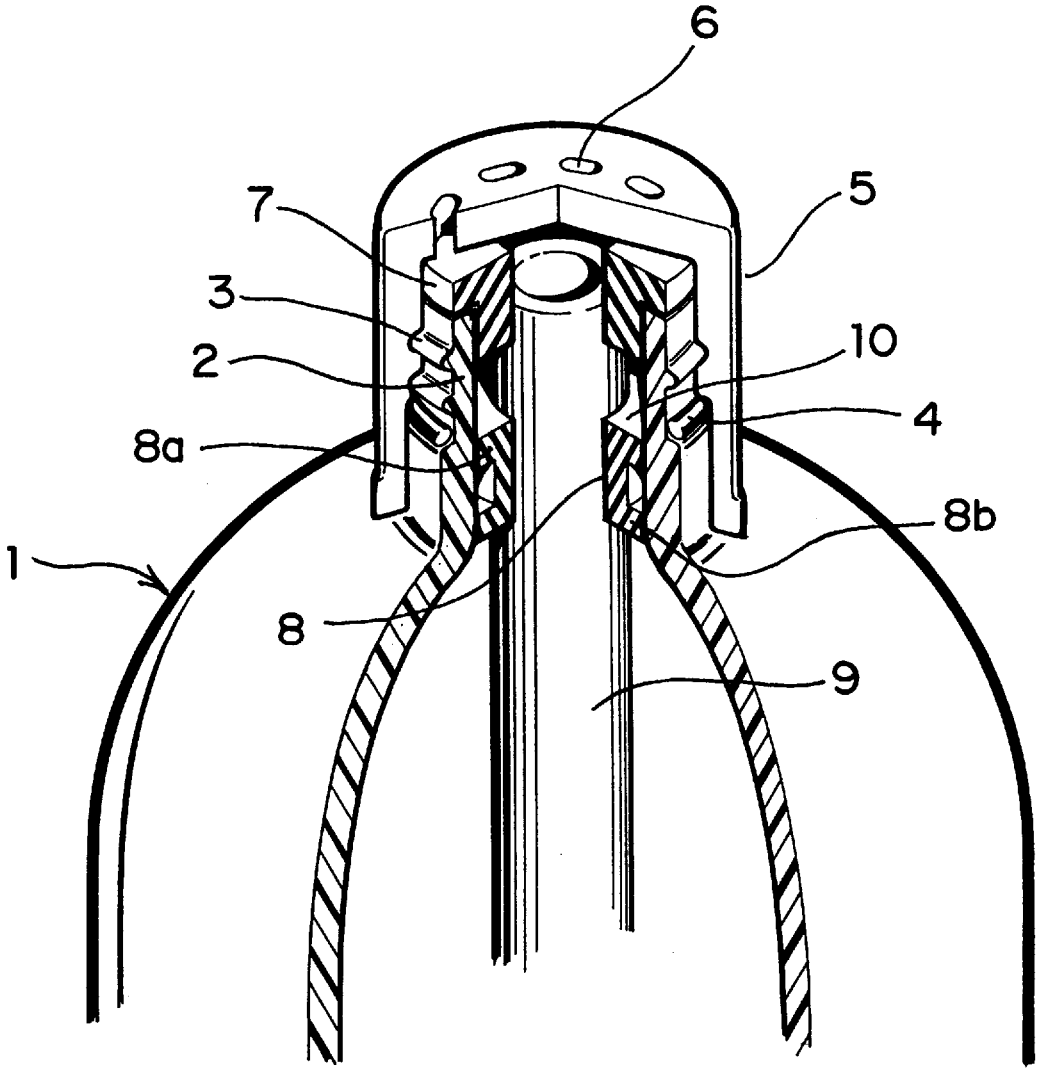
FIG. 2 shows a cross-section through the neck of the container.

The numeral 2 indicates the neck of the bottle having threads 3 thereon. The numeral 4 indicates an O-ring that slips over the neck 3 on the bottle and settles in the bottom of the thread 3 as can be seen in FIG. 2. Still referring to FIG. 1, 5 is a cap on the bottle having interior threads that match the exterior threads 3 on the neck 2 of the bottle. There is nothing unusual about this cap except that it shows the only modification having been made of all of the parts or components of the defensive spray container. To this end, a multiple of openings or holes 6 have been drilled into the top of the cap, the purpose of which will be explained below. There is a T-washer 7 which fits and is inserted into the interior of neck 3 and has a snug fit therein because it is made of rubber. Another insertion into the interior neck of the bottle 1 is a rubber grommet 8 having two radial flanges 8*a* and 8*b* extending therefrom at either of its ends. Finally, there is a liquid evacuation tube 9 which extends from the inside of the T-washer 7 to a close proximity of the bottom of bottle 1. The tube 9 has a press fit in the T-washer 7 and is securely held therein. When assembling the defensive spray container, all that is necessary is to insert the grommet 8 with the tube 9 inserted therein into the interior of the neck 3 whereby the flanges 8*a* and 8*b* will make intimate contact with the interior wall of neck 3. Because of this tight fit, the lower flange 8*b* will somewhat roll upwardly because of friction, while the upper flange 8*a* will settle into the interior cavities of the threads 3. The interior cavities are created during the molding process of the bottle 1. Next the T-shaped 7 washer is pressed into the opening of the bottle 1. The O-ring 4 is placed over the neck of the bottle 1 and the cap 5 is screwed onto the neck 3 and the multi-directional defensive spray container is fully assembled.

Operation of the Spray Container

Once the spray container is filled with the defensive or disabling fluid (which is not part of the invention), it can be displayed or placed anywhere. That is, it could be placed on a night table in the bedroom, in the bathroom or at several convenient places in the home. It could be camouflaged within a colorful paper sleeve as is shown at 11 in FIG. 2. The whole purpose is to confuse a predator or attacker to make him believe that the intended victim is unprepared or unarmed while in fact the inconspicuous bottle that looks like a soap bottle or a bottle used in make-up is quickly ready for use. The bottle could be carried in a purse, pocket, handbag or in the hand when walking in an isolated or dark place. When carrying the bottle, the liquid contained therein cannot leak out because the screw cap 5, when screwed down, intimately contacts the top of the T-washer whereby the openings or holes 6 on top of the screw cap 5 cannot receive any fluid at all.

In case of an attack, all the intended victim has to do is to give the screw cap a ⅛ or at most a ¼ turn, aim and just squeeze the bottle whereby the fluid will be expelled through the openings 6 at a high velocity. The intended victim cannot make a mistake in turning the cap because it can only be turned counter-clockwise. Tests have shown that the fluid can go as far as 15 feet. Of course, it all depends on how hard the bottle is being squeezed. When aiming the bottle, it can be aimed in all directions, that is, vertically, horizontally, sideways etc. In any direction, the fluid can and will be expelled. This can be repeated as long as fluid remains in the bottle. This is so because of the evacuation tube 9 reaching deep into the bottle. It should be noted that no fluid can escape from below the bottle cap 5 and onto the hand of a user because of the presence of O-ring 4. The O-ring 4 also serves as a counter pressure point when the fluid is being expelled which aids in propelling the fluid.

Experiments have shown that about 8 holes in the top of the cap are most efficient. It is also noted that the bottom rim of the bottle cap when screwed down will seat against the outer surface of the bottle so that no overtightening will occur.

What I claim is:

1. A multi-directional defensive spray container having a defensive fluid therein including a squeezable bottle having a neck with screw threads thereon, a rubber grommet having an evacuation tube contained therein being placed within and in contact with the interior wall of the neck of said bottle and tightly held therein, a rubber washer being placed over the opening of said neck, a screw cap having interior threads therein matching said threads on said neck of said bottle, said cap having a multiple of holes in its top face, said screw cap being screwed over the neck of said bottle until intimate contact is made with the top of said washer, expelling means effected by the application of an external force to the walls of said squeezable bottle.

2. The defensive spray container of claim 1, wherein said rubber washer is a T-washer.

3. The defensive spray container of claim 1, wherein said rubber grommet has a radial flange extending at each of its ends.

4. The defensive spray container of claim 1 including an O-ring placed over said neck of said bottle to seal the interior of said cap against said neck.

5. The defensive spray container of claim 1 including a loose camouflage hard paper sleeve into which said bottle may be placed so as to hide the same.

* * * * *